United States Patent [19]

Schreyer

[11] 4,043,538

[45] Aug. 23, 1977

[54] CHAIN HOIST

[75] Inventor: Kenneth D. Schreyer, Clarence, N.Y.

[73] Assignee: Columbus McKinnon Corporation, Tonawanda, N.Y.

[21] Appl. No.: 677,770

[22] Filed: Apr. 16, 1976

[51] Int. Cl.[2] ..... B66D 1/00

[52] U.S. Cl. ..... 254/168; D12/60; 248/318; 294/68; 294/77

[58] Field of Search ..... 254/167, 168, 169, 170, 254/171, 175.5; D12/60; 47/35; 150/48, 49, 50; 220/19, 83; 248/318; 228/182, 184, 192; 294/68, 69 R, 77

[56] References Cited

U.S. PATENT DOCUMENTS

| | | | |
|---|---|---|---|
| 1,279,033 | 9/1918 | Stollberg | 220/19 X |
| 1,848,929 | 3/1932 | Berg | 150/49 |
| 2,092,107 | 9/1937 | Coleman | 294/77 |
| 2,286,388 | 6/1942 | Smith | 254/168 |
| 2,297,332 | 9/1942 | Stewart | 294/77 X |
| 2,859,937 | 11/1958 | Robins et al. | 254/175.5 X |
| 3,142,507 | 7/1964 | Nilsson | 294/77 |

*Primary Examiner*—Robert J. Spar
*Assistant Examiner*—Donald W. Underwood
*Attorney, Agent, or Firm*—Bean, Kauffman & Bean

[57] ABSTRACT

An improved combination; chain hoist; slack chain transport chute; and slack chain receiving carrier depending therefrom. The carrier is of vertically flexible and overall resilient construction, so as to accommodate it to impacts from various sources under service conditions.

5 Claims, 6 Drawing Figures

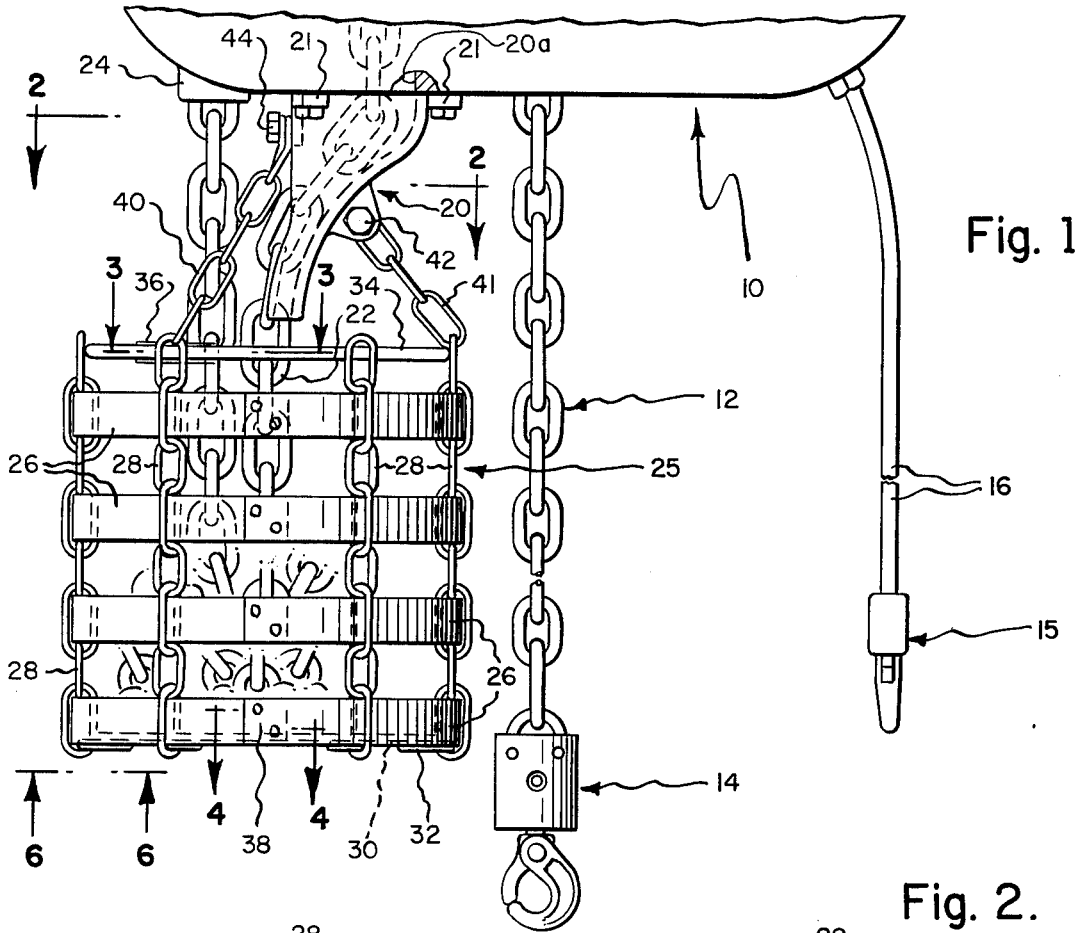
Fig. 1.
Fig. 2.
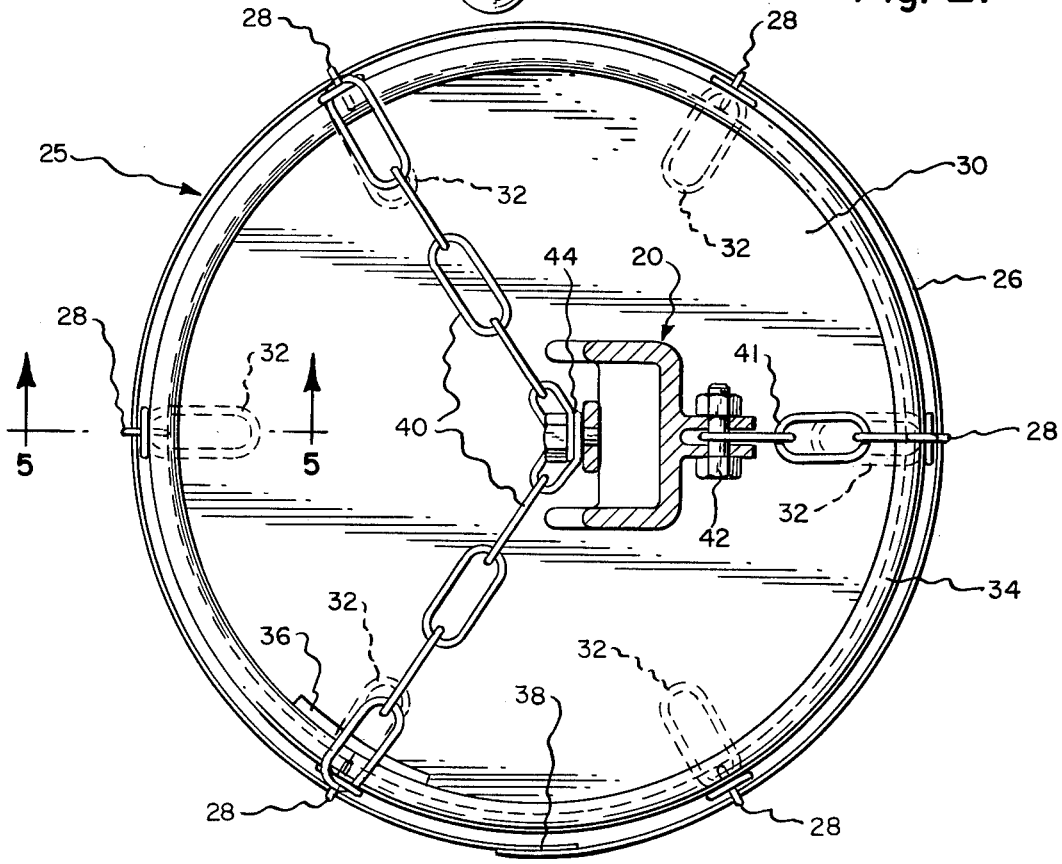

Fig. 3.
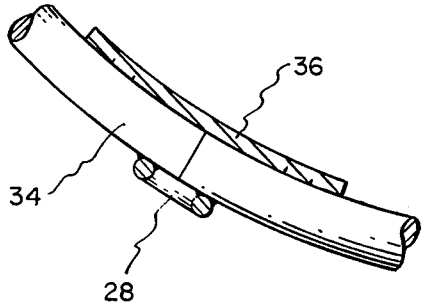
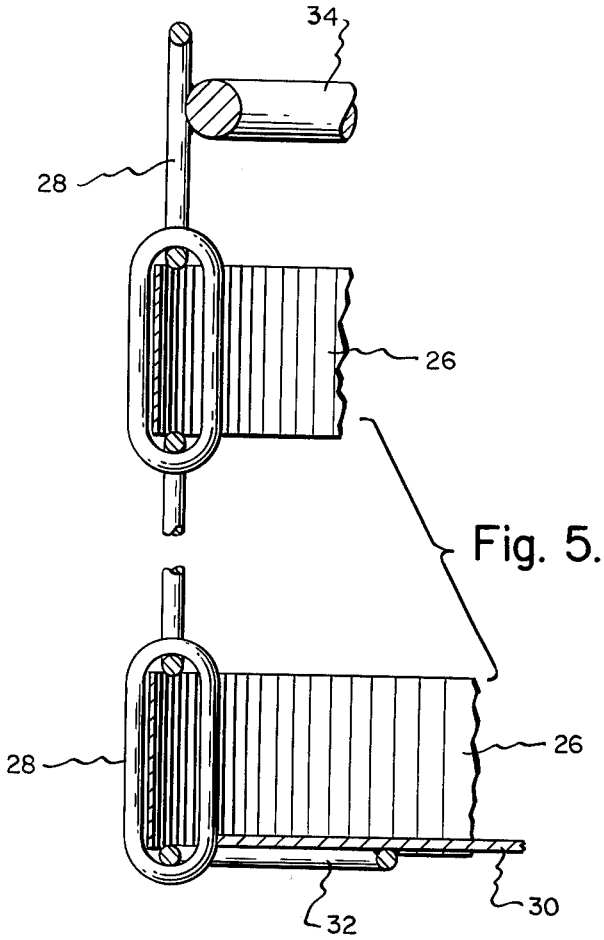
Fig. 5.
Fig. 4.
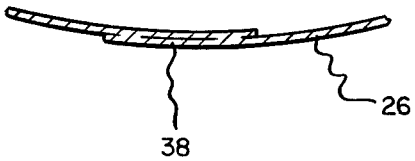
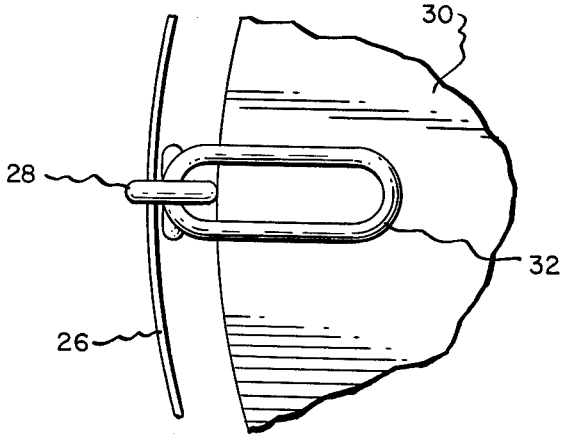
Fig. 6.

CHAIN HOIST

BACKGROUND AND OBJECTS OF THE INVENTION

As a chain hoist lifts a load, a slack chain portion of the load lift chain system exits from the hoist load lift wheel, and exits below the body of the hoist. It is essential from the standpoint of operating personnel safety/-convenience that this "slack" portion of the chain be kept out of the way of the operator's environment; and especially in the case of a trolley-carried hoist it is essential that the slack portion of the chain be confined within some kind of receiving bucket or carrier means at an elevation above the working environment, and into and out of which the slack portion of the chain may be freely be deposited/withdrawn. Slack chain receiving means have been previously furnished to the industry, but by nature of their construction and/or their suspension systems they have been unduly vulnerable to operational damaging hazards U.S. Pat. No. 2,859,937 illustrates an example of prior art constructions.

It is a primary object of the present invention to provide, in combination with an electric chain hoist an improved slack chain transport chute accessory device; and depending therefrom a vertically flexible and omnidirectionally resilient slack chain carrier. The carrier is formed of shock/wear resistant materials, and is therefore substantially invulnerable to damage whem slammed against such as by the load being lifted or such as when the carrying trolley conveys it against an obstacle. Inasmuch as the carrier comprises a combination of horizontally and vertically resilient components, external blows thereagainst have little or no damaging effects.

THE DRAWING

The invention is illustrated by way of example in the accompanying drawing wherein:

FIG. 1 is a fragmentary side elevational view of the lower portion of a chain hoist having a slack chain chute and flexible chain carrier arrangement suspended therefrom;

FIG. 2 is a sectional view through the chain chute and a plan view of the chain carrier, taken as indicated by line 2—2 of FIG. 1;

FIG. 3 is an enlarged scale fragmentary plan view of a detail of the carrier construction, taken as indicated by numeral 3 of FIG. 1;

FIG. 4 is a fragmentary sectional view on enlarged scale, taken as suggested by line 4—4 of FIG. 1;

FIG. 5 is an enlarged scale fragmentary view of details of the carrier construction, taken as suggested by line 5—5 of FIG. 2; and FIG. 6 is a fragmentary bottom plan view of the carrier on enlarged scale, taken as suggested by line 6—6 of FIG. 1.

DETAILED SPECIFICATION

As best shown at FIG. 1 the hoist-chute carrier combination of the invention may include an electric hoist body 10 (housing any suitable hoist motor, gearing chain "lift" wheel, braking devices; etc. not shown). The load lift chain depending from the hoist is illustrated generally at 12, and terminates in a load engaging hook "block" as illustrated at 14. The hoist control switch and associated electric cable are indicated at 15 and 16.

The slack chain transport chute device of the invention is designated generally at 20, and is illustrated as being bolted to the bottom of the hoist body as indicated at 21—21 in chain transport communication with a stack chain exit opening **20*a* formed in the hoist and body. The slack chain is illustrated at 22 as sliding downwardly and slightly outwardly (or upwardly) through the chute 20, as the hoist raises (or lowers) a load; the terminal end of the slack chain 22 being deadended to the hoist body, as indicated at 24**.

The slack chain carrier is designated generally at 25 and as illustrated comprises a plurality of horizontally disposed spaced apart spring metal hoops 26 which are vertically interconnected by means of chain strands 28. The bottom hoop 26 circumscribes a bottom plate 30. The lowermost chain links 32 of the chain strands 28 are folded inwardly and under the bottom plate 30; and are welded thereto as best shown at FIGS. 1, 2, 5, 6. The hoops 26 are threaded through appropriate links of the chain strands 28 for vertical support, and the upper ends of the chain strands 28 are welded to a relatively stiff top ring 34. As best shown in FIG. 5, the links of chain strands 28 are preferably sized to freely or loosely receive hoop 26. The ring 34 is formed of wire rod stock, circularly bent and butt-joined and welded to a splice plate 36 as best shown at FIG. 3; and operates to keep open at all times the mouth of the carrier for reception of the slack chain. The hoops 26 are formed of strap metal circularly bent, and are lap-jointed as indicated at 38 (FIGS. 1 and 4). The uppermost links of the carrier chains 28 are attached to the top ring 34 of the carrier so as to project slightly thereabove; thereby providing loops for attachment to carrier support chains 40–41.

The chain chute 20 is formed with an attachment boss 42 at the under side of the chute for connection to the support chain 41, and is formed at its opposite side with an attachment device 44 for connection to the upper ends of the chains 40—40. Thus it will be understood that the carrier 25 suspends by means of the support chains 40–40–41 from the chain chute 20, which in turn is mounted on the bottom of the hoist body by means of the connections 21—21; thereby providing a closely integrated and strong support combination. The carrier is thereby maintained at all times optimally positioned relative to the exit of the chain transport chute, while still being free to positionally shift and flex in response to various slack chain loading patterns, as well as to external blows, while at the same time maintaining the slack chain in the desired "out of way" place.

I claim:

1. In combination, a chain hoist including an enclosing body portion having a slack chain exit opening therethrough; a slack chain transport chute fixed to said hoist body portion in chain transport communication with said slack chain exit opening; a flexible slack chain carrier, said carrier comprising a plurality of hoops, a bottom member, and a plurality of vertically extending chain strands, said chain strands having their lower ends connected to said bottom member and being connected to said hoops above said lower ends to maintain said hoops relatively movable interconnected in a vertically spaced apart relationship and a lowermost of said hoops in a circumscribing relationship relative to said bottom member for confining said slack chain within said carrier while permitting vertical and horizontal flexures of said carrier as required to withstand without failure external blows occuring during use of said hoist; and flexible support means for suspending said carrier below said body portion in slack chain communication with said chute.

2. The combination as set forth in claim 1, wherein said lower ends of said chain strands are infolded under said bottom member and welded thereto, said hoops being threaded through alternate links of said chain strands, and said links being sized to loosely received said hoops.

3. In combination, a chain hoist including an enclosing body portion having a slack chain exit opening therethrough; a slack chain transport chute fixed to said hoist body in chain transport communication with said slack chain exit; a flexible slack chain carrier, said carrier comprising a bottom, a plurality of hoops, a relatively stiff top ring defining an open mouth for said carrier and a plurality of chain strands, said chain strands having lower links thereof fixed to said bottom, upper links thereof fixed to said ring and alternate intermediate links thereof loosely receiving said hoops whereby to maintain said hoops relatively movably interconnected in a vertically spaced apart relationship one to another and said ring and a lowermost of said hoops in a circumscribed relationship to said bottom for confining said slack chain within said carrier while permitting vertical and horizontal flexures of said carrier as required to withstand without failure external blows occuring during use of said hoist; and flexible support means for supporting said carrier below said body portion in slack chain communication with said chute.

4. The combination according to claim 3, wherein at least certain of said chain strands have additional links connected to said upper links thereof and serve to movably suspend said carrier beneath said body portion.

5. The combination according to claim 4, wherein said lower links are infolded under said bottom and welded thereto, said lowermost of said hoops is received within intermediate links of said chain strands immediate adjacent said lower links, said upper links are welded to said ring and define loops extending above said ring for attachment of said additional links thereto, and said additional links are connected to said chute.

* * * * *